US011280346B2

(12) United States Patent
Nowitzki et al.

(10) Patent No.: US 11,280,346 B2
(45) Date of Patent: Mar. 22, 2022

(54) IMPELLER STACK COMPRESSION DEVICE AND METHOD

(71) Applicant: Halliburton Energy Services, Inc., Houston, TX (US)

(72) Inventors: Wesley John Nowitzki, Tulsa, OK (US); Joshua W. Webster, Sand Springs, OK (US); Jason Hill, Bristow, OK (US); Joe D. Butler, Tulsa, OK (US); Justin Shrum, Calremore, OK (US); Bryan Mullins, Claremore, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/326,810

(22) PCT Filed: Apr. 25, 2018

(86) PCT No.: PCT/US2018/029317

§ 371 (c)(1),
(2) Date: Feb. 20, 2019

(87) PCT Pub. No.: WO2019/209283

PCT Pub. Date: Oct. 31, 2019

(65) Prior Publication Data

US 2021/0332827 A1 Oct. 28, 2021

(51) Int. Cl.
*F04D 29/22* (2006.01)
*F04D 29/18* (2006.01)
(Continued)

(52) U.S. Cl.
CPC ..... *F04D 29/22* (2013.01); *F04D 13/10* (2013.01); *F04D 29/044* (2013.01); *F04D 29/185* (2013.01); *F04D 29/20* (2013.01)

(58) Field of Classification Search
CPC ..... F04D 1/025; F04D 13/10; F04D 29/043; F04D 29/044; F04D 29/053; F04D 29/054; F04D 29/185; F04D 29/20; F04D 29/22
See application file for complete search history.

(56) References Cited

U.S. PATENT DOCUMENTS 5,033,937 A 7/1991 Wilson
6,752,560 B2 * 6/2004 Wilson ..... F04D 29/044 403/1

(Continued)

FOREIGN PATENT DOCUMENTS

EP 2366904 A1 9/2011

OTHER PUBLICATIONS

International Search Report and The Written Opinion, dated Jan. 24, 2019, PCT/US2018/029317, 11 pages, ISA/KR.

*Primary Examiner* — Richard A Edgar
*Assistant Examiner* — Jason G Davis
(74) *Attorney, Agent, or Firm* — Haynes and Boone, LLP

(57) ABSTRACT

A method and apparatus for a centrifugal pump according to which an annular retainer is positioned around a first end portion of a pump shaft, an open end portion of a compression cylinder is positioned around the first end portion of the pump shaft so that the pump shaft extends within an internal cavity of the compression cylinder, the compression cylinder is moved towards an annular groove formed in the first end portion of the pump shaft, and the annular retainer is sprung into the annular groove. In some embodiments, springing the annular retainer into the annular groove constrains one or more impellers and one or more annular spacers between the annular retainer and another annular retainer connected to the pump shaft.

19 Claims, 10 Drawing Sheets

(51) Int. Cl.

| | |
|---|---|
| ***F04D 29/20*** | (2006.01) |
| ***F04D 29/044*** | (2006.01) |
| ***F04D 13/10*** | (2006.01) |

(56) References Cited

U.S. PATENT DOCUMENTS

| | | | | |
|---|---|---|---|---|
| 6,866,271 | B2 * | 3/2005 | MacDonald | F16J 15/3276 277/353 |
| 7,290,984 | B2 * | 11/2007 | Volk | F04D 1/063 415/199.2 |
| 8,287,235 | B2 | 10/2012 | Orban et al. | |
| 2014/0209292 | A1 * | 7/2014 | Watson | F04D 29/086 166/105 |
| 2016/0201444 | A1 | 7/2016 | Hardee et al. | |
| 2017/0102009 | A1 | 4/2017 | Johnson et al. | |
| 2018/0298910 | A1 * | 10/2018 | Watson | F04D 29/0413 |

* cited by examiner

IMPELLER STACK COMPRESSION DEVICE AND METHOD

PRIORITY

The present application is a U.S. National Stage patent application of International Patent Application No. PCT/US2018/029317, filed on Apr. 25, 2018, the benefit of which is claimed and the disclosure of which is incorporated herein by reference in its entirety.

TECHNICAL FIELD

The present disclosure relates generally to oil or gas wellbore equipment, and, more particularly, to an impeller stack compression device for compressing the impeller stack of, for example, an electric submersible pump.

BACKGROUND

Many electric submersible pumps are centrifugal pumps including one or more impellers connected to a pump shaft and disposed within one or more diffusers to pump fluid to the surface from a subterranean wellbore. One or more spacers may be interposed between the plurality of impellers on the pump shaft to maintain appropriate spacing between the impellers. The one or more spacers and the one or more impellers (collectively, the "impeller stack") are axially compressed onto the pump shaft using a compression device. However, existing compression devices are bulky and expensive devices that include machined threads used to mechanically compress the impeller stack onto the pump shaft, and which remain on the pump shaft during operation of the centrifugal pump. Because existing compression devices remain on the pump shaft during operation of the centrifugal pump, they can impede or obstruct fluid flow through the centrifugal pump, thereby causing undesirable turbulence in the fluid flow and/or vibration of the centrifugal pump. Therefore, what is needed is an apparatus, system, or method that addresses one or more of the foregoing issues, and/or one or more other issues.

BRIEF DESCRIPTION OF THE DRAWINGS

FIG. 1(*b*) is a cross-sectional view of another part of the centrifugal pump of FIG. 1(*a*), according to one or more embodiments of the present disclosure.

FIG. 5(*b*) is a cross-sectional view of the impeller stack compression device of FIG. 4 in a second phase of installing the annular retainer on part of the centrifugal pump shown in FIGS. 1(*a*) and 1(*b*), according to one or more embodiments of the present disclosure.

FIG. 5(*c*) is a cross-sectional view of the impeller stack compression device of FIG. 4 in a third first phase of installing the annular retainer on part of the centrifugal pump shown in FIGS. 1(*a*) and 1(*b*), according to one or more embodiments of the present disclosure.

FIG. 5(*d*) is an enlarged cross-sectional view of FIG. 5(*c*) illustrating the impeller stack compression device of FIG. 4 in the third phase of installing the annular retainer on part of the centrifugal pump shown in FIGS. 1(*a*) and 1(*b*), according to one or more embodiments of the present disclosure.

FIG. 5(*e*) is an enlarged cross-sectional view similar to that shown in FIG. 5(*d*) illustrating the impeller stack compression device of FIG. 4 in a fourth phase of installing the annular retainer on part of the centrifugal pump shown in FIGS. 1(*a*) and 1(*b*), according to one or more embodiments of the present disclosure.

DETAILED DESCRIPTION

Figure 1A:
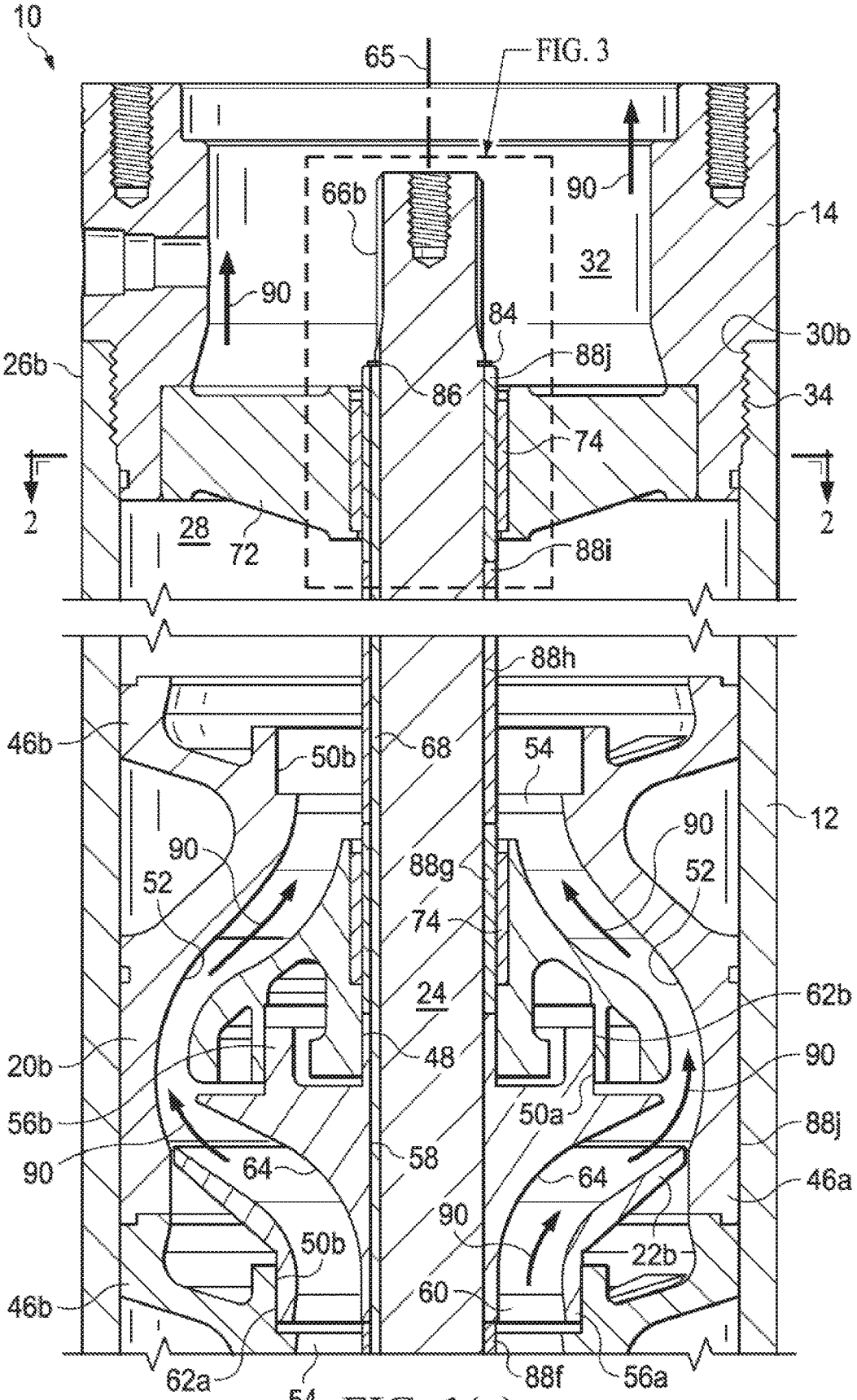
FIG. 1(*a*) is a cross-sectional view of part of a centrifugal pump, according to one or more embodiments of the present disclosure.
Figure 1B:
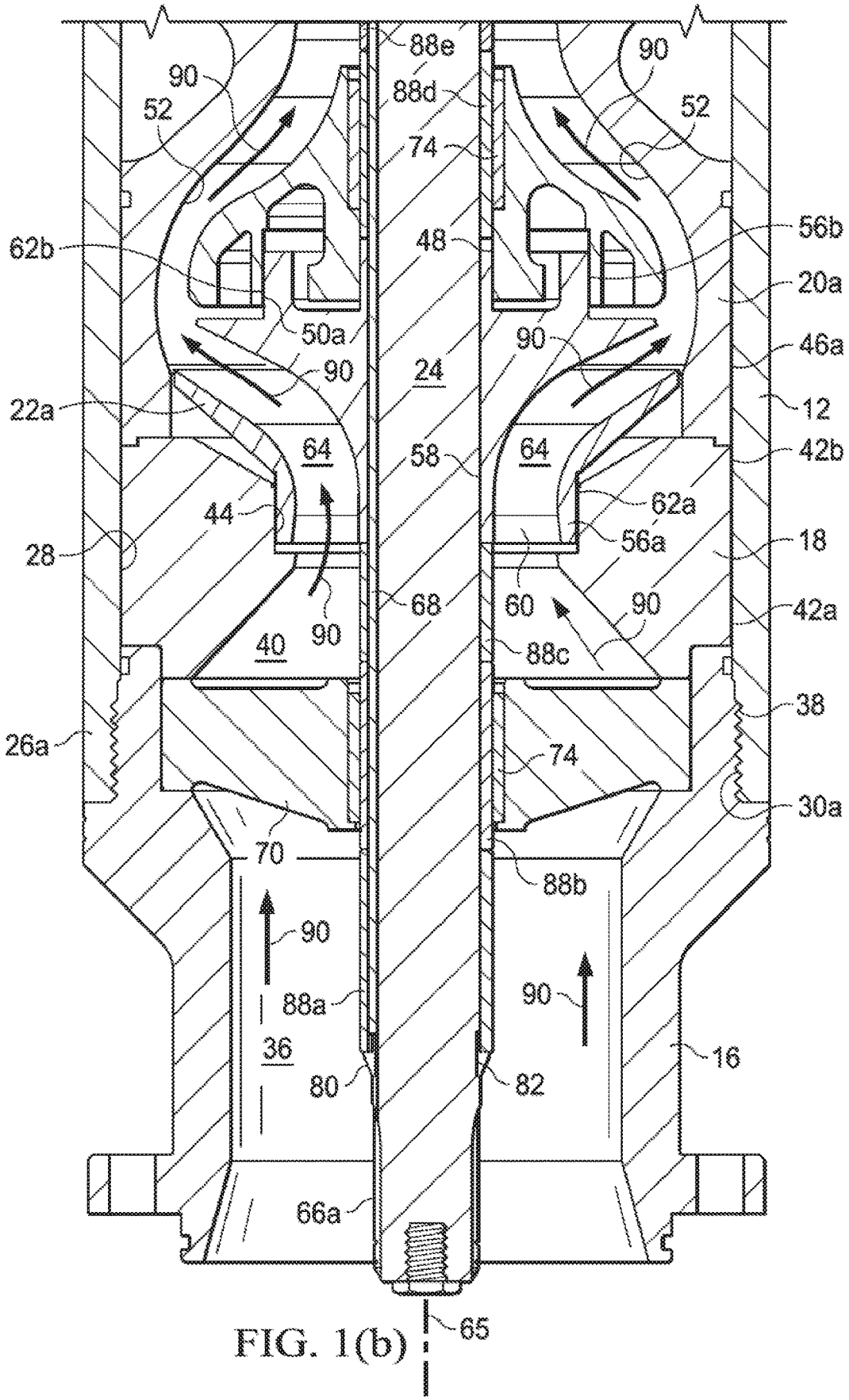

In an embodiment, as illustrated in FIGS. 1(*a*) and 1(*b*), a centrifugal pump is generally referred to by the reference numeral 10. In some embodiments, the centrifugal pump is or is part of an electric submersible pump. The centrifugal pump 10 includes a pump casing 12, a discharge head 14, a suction head 16, a suction adapter 18, a plurality of diffusers, including at least the diffusers 20*a* and 20*b*, a plurality of impellers, including at least the impellers 22*a* and 22*b*, and a pump shaft 24. The pump casing 12 is a tubular member defining opposing end portions 26*a* and 26*b* and an internal passage 28. In some embodiments, the pump casing 12 includes an internal connection 30*a* or 30*b* at each of the opposing end portions 26*a* and 26*b*, respectively. The discharge head 14 is a tubular member defining an internal passage 32 and is connected to the pump casing 12 at the end portion 26*b*. In some embodiments, the discharge head 14 includes an external connection 34 connectable to the internal connection 30*b* at the end portion 26*b* of the pump casing 12. The suction head 16 is a tubular member defining an internal passage 36 and is connected to the pump casing 12 at the end portion 26*a*. In some embodiments, the suction head 16 includes an external connection 38 connectable to the internal connection 30*a* at the end portion 26*a* of the pump casing 12. The suction adapter 18 is a tubular member extending within the internal passage 28 of the pump casing 12 adjacent the suction head 16. The suction adapter 18 defines an internal passage 40 and opposing end portions 42*a* and 42*b*. In some embodiments, the suction adapter 18 includes an internal suction hub 44.

Referring still to FIGS. 1(*a*) and 1(*b*), the diffuser 20*a* extends within the internal passage 28 of the pump casing 12 adjacent the suction adapter 18 and opposite the suction head 16. Similarly, the diffuser 20*b* extends within the internal passage 28 of the pump casing 12 adjacent another one of the plurality of diffusers, such as, for example, the diffuser 20*a*, and opposite the suction adapter 18. In some embodiments, the plurality of diffusers, including the diffusers 20*a* and 20*b*, each define opposing end portions 46*a* and 46*b* and include a central bore 48, an internal discharge hub 50*a*, a plurality of diffuser vanes 52, a diffuser eye 54, and an internal suction hub 50*b*. The plurality of impellers, including the impeller 22*a* and the impeller 22*b*, each define opposing end portions 56*a* and 56*b* and include a central bore 58, an impeller eye 60, an external suction hub 62*a*, a plurality of impeller vanes 64, and an external discharge hub 62*b*. The pump shaft 24 defines a central axis 65 and opposing end portions 66*a* and 66*b* and extends through the central bore 58 of each of the plurality of impellers, including the impellers 22*a* and 22*b*. In some embodiments, the plurality of impellers, including the impellers 22*a* and 22*b*, are each connectable to the pump shaft 24 via a key 68. In addition to, or instead of, the key 68, the plurality of impellers, including the impellers 22*a* and 22*b*, may be splined or threaded to the pump shaft 24.

In some embodiments, the impeller 22*a* extends within the internal passage 40 at the end portion 42*b* of the suction adapter 18 and the end portion 46*a* of the diffuser 20*a* so that the external suction hub 62*a* of the impeller 22*a* engages the internal suction hub 44 of the suction adapter 18 and the external discharge hub 62*b* of the impeller 22*a* engages the internal discharge hub 50*a* of the diffuser 20*a*. As a result, when the pump shaft 24 rotates the impeller 22*a* within the diffuser 20*a*, the impeller eye 60 of the impeller 22*a* is configured to receive fluid from the internal passage 40 at the end portion 42*a* of the suction adapter 18 and to discharge said received fluid through the plurality of impeller vanes 64 of the impeller 22*a* into the plurality of diffuser vanes 52 of the diffuser 20*a*, as will be described in further detail below. In some embodiments, one or more wear rings are disposed between the external suction hub 62*a* of the impeller 22*a* and the internal suction hub 44 of the suction adapter 18. In some embodiments, one or more wear rings are disposed between the external discharge hub 62*b* of the impeller 22*a* and the internal discharge hub 50*a* of the diffuser 20*a*.

In some embodiments, the impeller 22*b* extends within the end portion 46*a* of the diffuser 20*b* and the end portion 46*b* of another one of the plurality of diffusers, such as, for example, the diffuser 20*a*, so that the external suction hub 62*a* of the impeller 22 engages the internal suction hub 50*b* of the diffuser (e.g., the diffuser 20*a*) and the external discharge hub 62*b* of the impeller 22*b* engages the internal discharge hub 50*a* of the diffuser 20*b*. As a result, when the pump shaft 24 rotates the impeller 22*b* within the diffuser 20*b*, the impeller eye 60 of the impeller 22*b* is configured to receive fluid from the diffuser eye 54 at the end portion of the diffuser (e.g., the diffuser 20*a*) and to discharge said received fluid through the plurality of impeller vanes 64 of the impeller 22*b* into the plurality of diffuser vanes 52 of the diffuser 20*b*, as will be described in further detail below. In some embodiments, one or more wear rings are disposed between the external suction hub 62*a* of the impeller 22*b* and the internal suction hub 50*b* of the diffuser (e.g., the diffuser 20*a*). In some embodiments, one or more wear rings are disposed between the external discharge hub 62*b* of the impeller 22*b* and the internal discharge hub 50*a* of the diffuser 20*b*.

Figure 2:
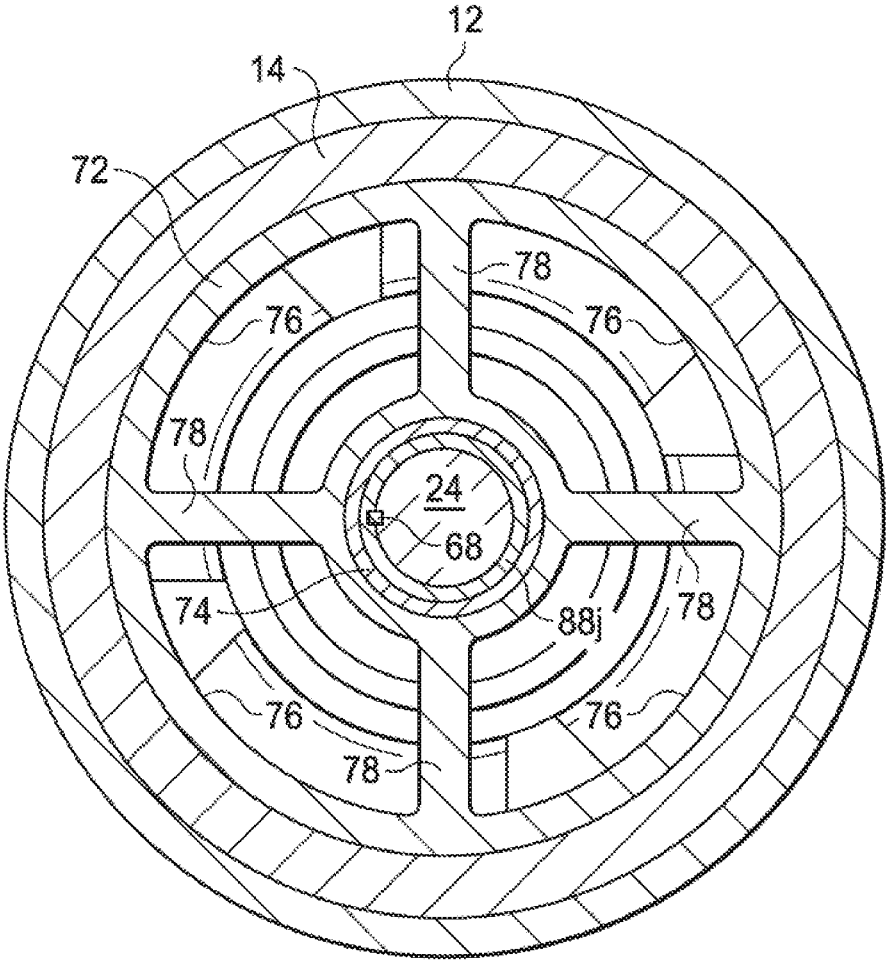
FIG. 2 is a cross-sectional view of the centrifugal pump of FIGS. 1(*a*) and 1(*b*) taken along the line 2-2 of FIG. 1(*a*), according to one or more embodiments of the present disclosure.

Referring still to FIGS. 1(*a*) and 1(*b*), the pump shaft 24 is configured to rotate the plurality of impellers, including the impellers 22*a* and 22*b*, within the plurality of diffusers, including the diffusers 20*a* and 20*b*, respectively. To facilitate said rotation, the pump shaft 24 is rotatably supported at the end portion 66*a* and within the suction head 16 by a suction centralizer 70, the pump shaft 24 is rotatably supported between the end portions 66*a* and 66*b* and within the pump casing 12 by the plurality of diffusers, including the diffusers 20*a* and 20*b*, and the pump shaft 24 is rotatably supported at the end portion 66*b* and within the discharge head 14 by a discharge centralizer 72. More particularly, the suction centralizer 70, the plurality of diffusers, including the diffusers 20*a* and 20*b*, and the discharge centralizer 72 each accommodate a bushing 74, which bushings 74, in combination, rotatably support the pump shaft 24 from the end portion 66*a* to the end portion 66*b* thereof. Turning also to FIG. 2, with continuing reference to FIG. 1(*a*), the discharge centralizer 72 is supported within, and connected to the discharge head 14 and includes a plurality centralizer vanes 76 interposed circumferentially between a corresponding plurality of radial centralizer spokes 78. The plurality of centralizer vanes 76 are configured to permit passage of a fluid during operation of the centrifugal pump 10, as will be described in further detail below. In some embodiments, the suction centralizer 70 is substantially identical to the discharge centralizer 72 and is supported within, and connected to, the suction head 16 in substantially the same manner as the manner in which the discharge centralizer is supported within, and connected to, the discharge head 14; therefore, the suction centralizer 70 will not be described in further detail.

Figure 3:
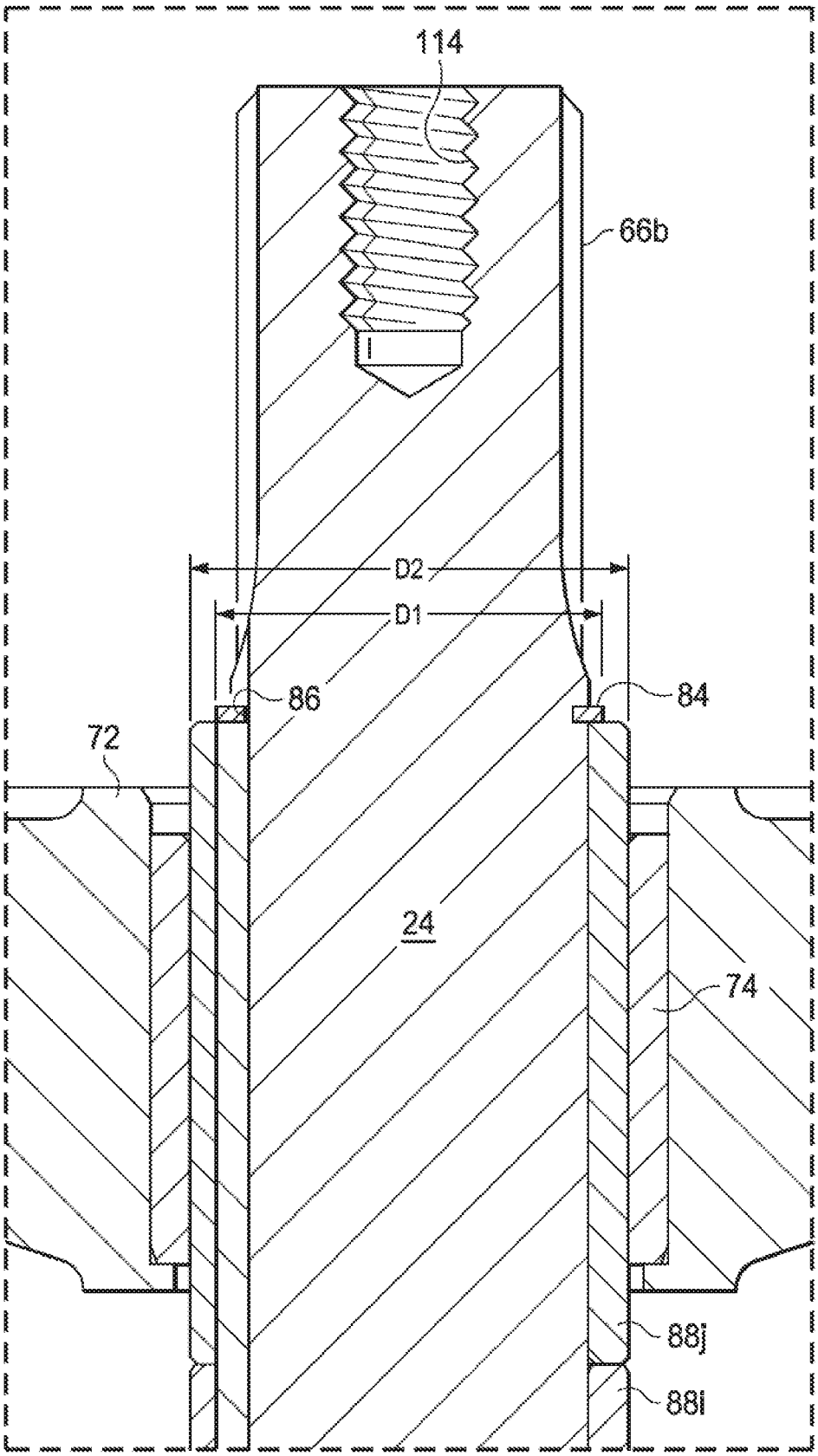
FIG. 3 is an enlarged cross-sectional view of the part of the reciprocating pump of FIGS. 1(*a*) and 1(*b*) shown in FIG. 1(*a*), according to one or more embodiments of the present disclosure.

Referring back to FIGS. 1(*a*) and 1(*b*), an annular retainer 80 is disposed within an annular groove 82 formed in the end portion 66*a* of the pump shaft 24. In some embodiments, the annular groove 82 is omitted and the annular retainer 80 is integrally formed with the pump shaft 24. In some embodiments, the annular retainer 80 is non-detachably connected to the pump shaft 24 (i.e., in the sense that detaching the annular retainer 80 from the pump shaft 24 requires destruction—or at least elastic deformation—of the annular retainer 80). Turning also to FIG. 3, with continuing reference to FIG. 1(*a*), in some embodiments, an annular retainer 84 is disposed within an annular groove 86 formed in the end portion 66*b* of the pump shaft 24. In some embodiments, the annular retainer 84 is detachably connected to the pump shaft 24 (i.e., in the sense that attaching or detaching the annular retainer 84 from the pump shaft 24 merely requires an inelastic deformation of the annular retainer 84). In some embodiments, the annular retainer 84 is a spiral retainer ring; however, in other embodiments, the annular retainer 84 may be, include, or be part of, for example, a constant section retainer ring, a tapered section retainer ring, a split retainer ring, a push-on or push nut retainer ring, a crescent retainer ring, a round retainer ring, a snap ring or any other suitable retainer ring.

Referring back again the FIGS. 1(*a*) and 1(*b*), in some embodiments, the centrifugal pump 10 includes a plurality of annular spacers, including at least annular spacers 88*a-j*. In some embodiments, the plurality of annular spacers, including the annular spacers 88*a-j*, are each connectable to the pump shaft 24 via the key 68. In addition to, or instead of, the key 68, the plurality of annular spacers, including the annular spacers 88*a-j*, may be splined or threaded to the pump shaft 24. The respective bushings 74 accommodated by the suction centralizer 70, the plurality of diffusers, including the diffusers 20*a* and 20*b*, and the discharge centralizer 72 each rotatably support the pump shaft 24 via engagement with one or more of the annular spacers 88*a*1 connected to the pump shaft 24. The pump shaft 24, the plurality of annular spacers, including the annular spacers 88*a-j*, and the plurality of impellers, including the impellers 22*a* and 22*b*, in combination, are thus configured to rotate relative to at least the suction head 16, the suction centralizer 70, the suction adapter 18, the pump casing 12, the plurality of diffusers, including the diffusers 20*a* and 20*b*, the discharge head 14, and the discharge centralizer 72, as will be described in further detail below. In some embodiments, the plurality of annular spacers, including at least the annular spacers 88*a-j*, maintain proper spacing between the annular retainer 80, the impeller 22*a*, the impeller 22*b*, and the annular retainer 84 so that the impellers 22*a* and 22*b* are properly positioned within the diffusers 20*a* and 20*b*, respectively, to facilitate efficient operation of the centrifugal pump 10.

For example, the annular spacers 88*a-c* are positioned axially between the annular retainer 80 and the impeller 22*a* so that the annular spacer 88*a* is engageable with the annular retainer 80 and the annular spacer 88*b*, the annular spacer 88*b* is engageable with the annular spacer 88*a* and the annular spacer 88*c*, and the annular spacer 88*c* is engageable with the annular spacer 88*b* and the end portion 56*a* of the impeller 22*a*. When so engaged, the annular spacers 88*a-c* maintain proper spacing between the annular retainer 80 and the impeller 22*a* so that the impeller 22*a* is properly positioned within the diffuser 20*a* to facilitate efficient operation of the centrifugal pump 10. In some embodiments, at least one of the annular spacers 88*a-c* is integrally formed with at least one other of the annular spacers 88*a-c*. In some embodiments, at least one of the annular spacers 88*a-c* is split into multiple annular spacers positioned axially between the annular retainer 80 and the impeller 22*a*. Thus, any number of annular spacers (e.g., one, two, three, four, five, six, seven, eight, nine, ten, or more annular spacers) may be positioned axially between the annular retainer 80 and the impeller 22*a* so as to maintain proper spacing between the annular retainer 80 and the impeller 22*a*.

For another example, the annular spacers 88*d-f* are positioned axially between the impeller 22*a* and the impeller 22*b* so that the annular spacer 88*d* is engageable with the end portion 56*b* of the impeller 22*a* and the annular spacer 88*e*, the annular spacer 88*e* is engageable with the annular spacer 88*d*, and the annular spacer 88*f* is engageable with the end portion 56*a* of the impeller 22*b*. When so engaged, at least the annular spacers 88*d-f* maintain proper spacing between the impellers 22*a* and 22*b* so that the impellers 22*a* and 22*b* are properly positioned within the diffuser 20*a* and 20*b*, respectively, to facilitate efficient operation of the centrifugal pump 10. In some embodiments, at least one of the annular spacers 88*d-f* is integrally formed with at least one other of the annular spacers 88*d-f*. In some embodiments, at least one of the annular spacers 88*d-f* is split into multiple annular spacers positioned axially between the impeller 22*a* and the impeller 22*b*. Thus, any number of annular spacers (e.g., one, two, three, four, five, six, seven, eight, nine, ten, or more annular spacers) may be positioned axially between the annular retainer 80 and the impeller 22*a* so as to maintain proper spacing between the annular retainer 80 and the impeller 22*a*.

For yet another example, the annular spacers 88*g-j* are positioned axially between the impeller 22*b* and the annular retainer 84 so that the annular spacer 88*g* is engageable with the end portion 56*b* of the impeller 22*b*, the annular spacer 88*h* is engageable with the annular spacer 88*g* and the annular spacer 88*i*, the annular spacer 88*i* is engageable with the annular spacer 88*h* and the annular spacer 88*j*, and the annular spacer 88*j* is engageable with the annular spacer 88*i* and the annular retainer 84. When so engaged, the annular spacers 88*g-j* maintain proper spacing between the impeller 22*b* and the annular retainer 84 so that the impeller 22*b* is properly positioned within the diffuser 20*b* to facilitate efficient operation of the centrifugal pump 10. In some embodiments, at least one of the annular spacers 88*g-j* is integrally formed with at least one other of the annular spacers 88*g-j*. In some embodiments, at least one of the annular spacers 88*g-j* is split into multiple annular spacers positioned axially between the impeller 22*b* and the annular retainer 84. Thus, any number of annular spacers (e.g., one, two, three, four, five, six, seven, eight, nine, ten, or more annular spacers) may be positioned axially between the impeller 22*b* and the annular retainer 84 so as to maintain proper spacing between the impeller 22*b* and the annular retainer 84.

In operation, as illustrated in FIGS. 1(*a*) and 1(*b*), the pump shaft 24 is rotated about the central axis 65; this rotation of the pump shaft 24 about the central axis 65 causes the plurality of annular spacers, including the annular spacers 88*a-j*, and the plurality of impellers, including the impellers 22*a* and 22*b*, to rotate together with the pump shaft 24 about the central axis 65. More particularly, the pump shaft 24, the plurality of annular spacers, including the annular spacers 88*a-j*, and the plurality of impellers, including the impellers 22*a* and 22*b*, in combination, rotate about the central axis 65 relative to at least the suction head 16, the suction centralizer 70, the suction adapter 18, the pump casing 12, the plurality of diffusers, including the diffusers 20*a* and 20*b*, the discharge head 14, and the discharge centralizer 72. Said rotation causes fluid to flow at least through the internal passage 36 of the suction head 16 and the plurality of centralizer vanes 76 of the suction centralizer 70, into the internal passage 40 of the suction adapter 18 at the end portion 42*a* thereof, into the impeller eye 60 of the impeller 22*a*, through the plurality of impeller vanes 64 of the impeller 22*a*, into the plurality of diffuser vanes 52 of the diffuser 20*a*, through the diffuser eye 54 of the diffuser 20*a*, into the impeller eye 60 of the impeller 22*b*, through the plurality of impeller vanes 64 of the impeller 22*b*, into the plurality of diffuser vanes 52 of the diffuser 20*b*, through the diffuser eye 54 of the diffuser 20*b*, into the internal passage 28 of the pump casing 12 at the end portion 26*b* thereof, and through the plurality of centralizer vanes 76 of the suction centralizer 70 and the internal passage 36 of the suction head 16, as indicated by the arrows 90 in FIGS. 1(*a*) and 1(*b*). In some embodiments, the annular retainer 84 has a negligible effect on the fluid flowing through the plurality of centralizer vanes 76 of the suction centralizer 70 and the internal passage 36 of the suction head 16. In some embodiments, the annular retainer 84 decreases the amount of turbulence generated in the fluid flowing through the plurality of centralizer vanes 76 of the suction centralizer 70 and the internal passage 36 of the suction head 16 as compared to existing compression devices.

During the rotation of the pump shaft 24 about the central axis 65, the respective bushings 74 accommodated by the suction centralizer 70, the plurality of diffusers, including the diffusers 20*a* and 20*b*, and the discharge centralizer 72 each rotatably support the pump shaft 24 via engagement with one or more of the annular spacers 88*a-j* connected to the pump shaft 24. Further, during the rotation of the pump shaft 24 about the central axis 65: the external suction hub 62*a* of the impeller 22*a* rotatably engages the internal suction hub 44 of the suction adapter 18; the external discharge hub 62*b* of the impeller 22*a* rotatably engages the internal discharge hub 50*a* of the diffuser 20*a*; the external suction hub 62*a* of the impeller 22 rotatably engages the internal suction hub 50*b* of the diffuser (e.g., the diffuser 20*a*); and the external discharge hub 62*b* of the impeller 22*b* rotatably engages the internal discharge hub 50*a* of the diffuser 20*b*. In some embodiments, such engagement occurs between: the one or more wear rings disposed between the external suction hub 62*a* of the impeller 22*a* and the internal suction hub 44 of the suction adapter 18; the one or more wear rings are disposed between the external discharge hub 62*b* of the impeller 22*a* and the internal discharge hub 50*a* of the diffuser 20*a*; the one or more wear rings are disposed between the external suction hub 62*a* of the impeller 22*b* and the internal suction hub 50*b* of the diffuser (e.g., the diffuser 20*a*); and/or the one or more wear rings are disposed between the external discharge hub 62*b* of the impeller 22*b* and the internal discharge hub 50*a* of the diffuser 20*b*. Finally, during the rotation of the pump shaft 24 about the central axis 65, the plurality of annular spacers, including at least the annular spacers 88*a-j*, maintain proper spacing between the annular retainer 80, the impeller 22*a*, the impeller 22*b*, and the annular retainer 84 so that the impellers 22*a* and 22*b* are properly positioned within the diffusers 20*a* and 20*b*, respectively, to facilitate efficient operation of the centrifugal pump 10.

Figure 4:
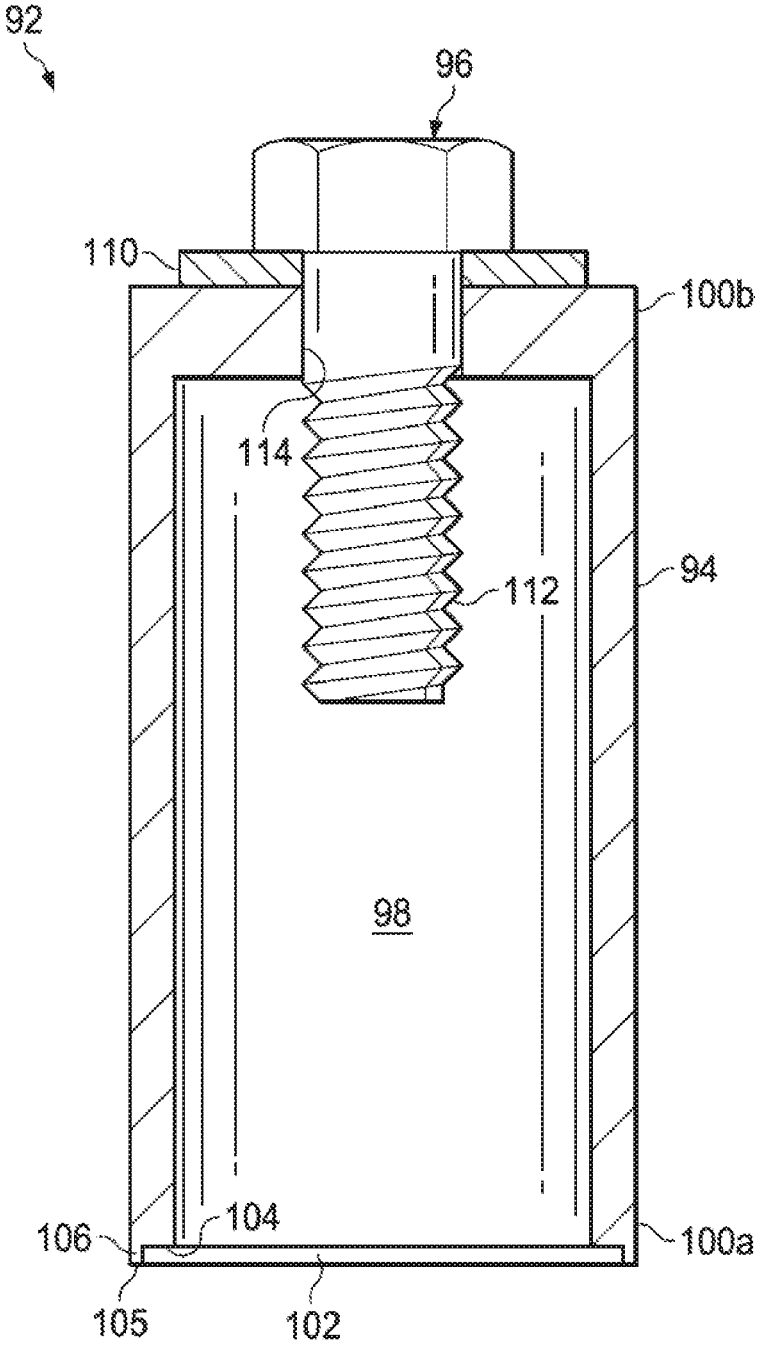
FIG. 4 is a cross-sectional view of an impeller stack compression device, according to one or more embodiments of the present disclosure.
Figure 5A:
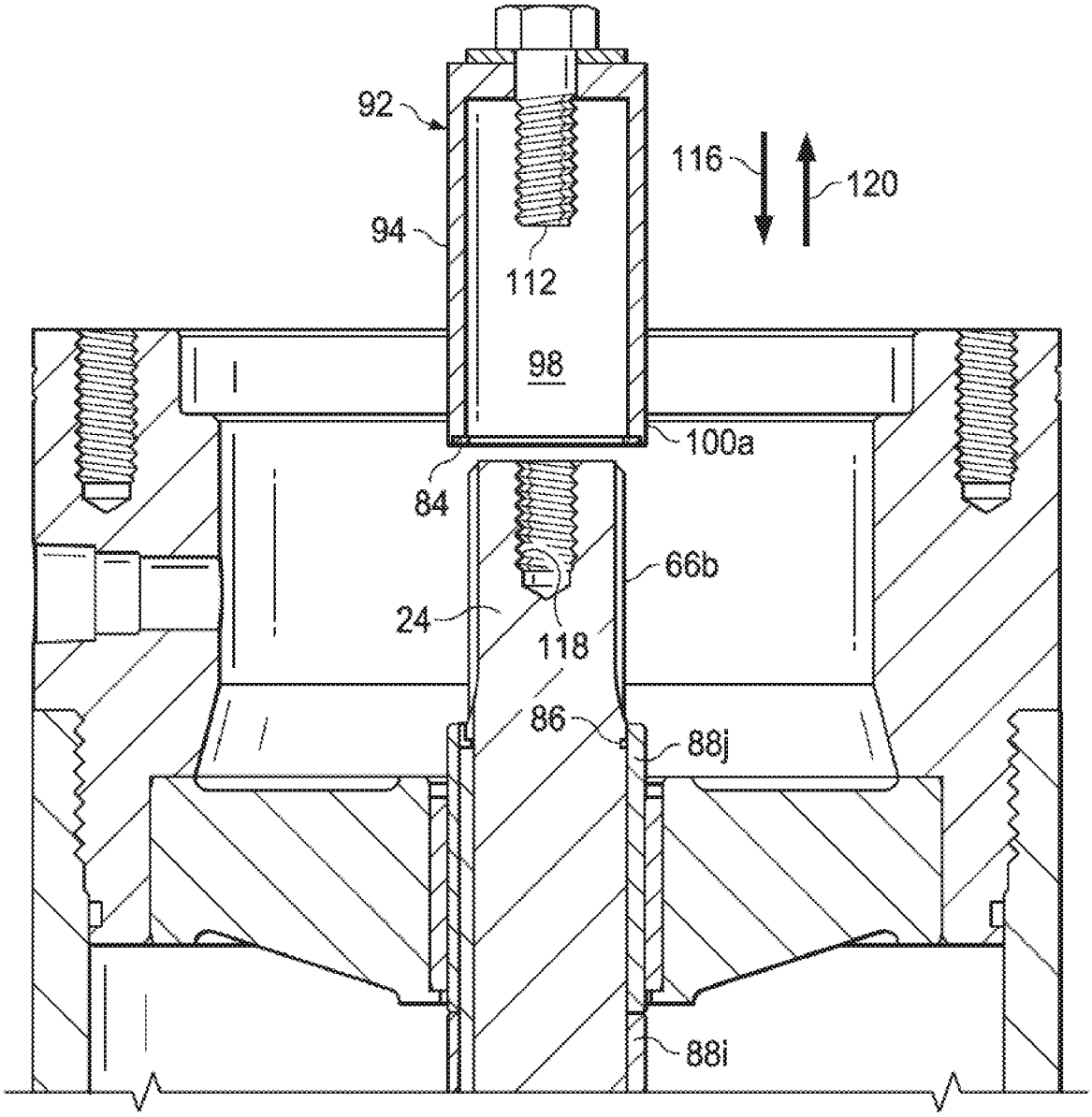
FIG. 5(*a*) is a cross-sectional view of the impeller stack compression device of FIG. 4 in a first phase of installing an annular retainer on part of the centrifugal pump shown in FIGS. 1(*a*) and 1(*b*), according to one or more embodiments of the present disclosure.
Figure 5B:
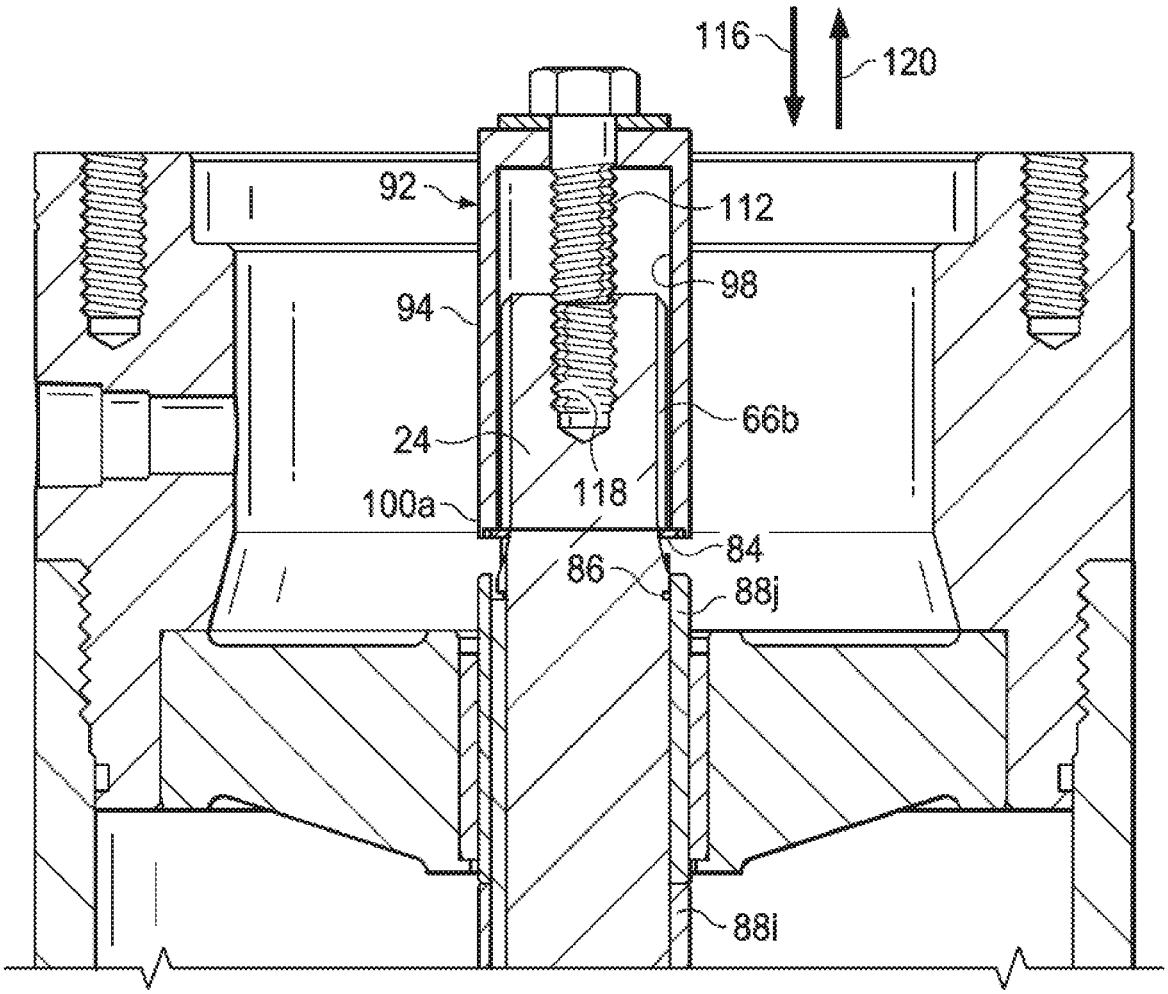
Figure 5C:
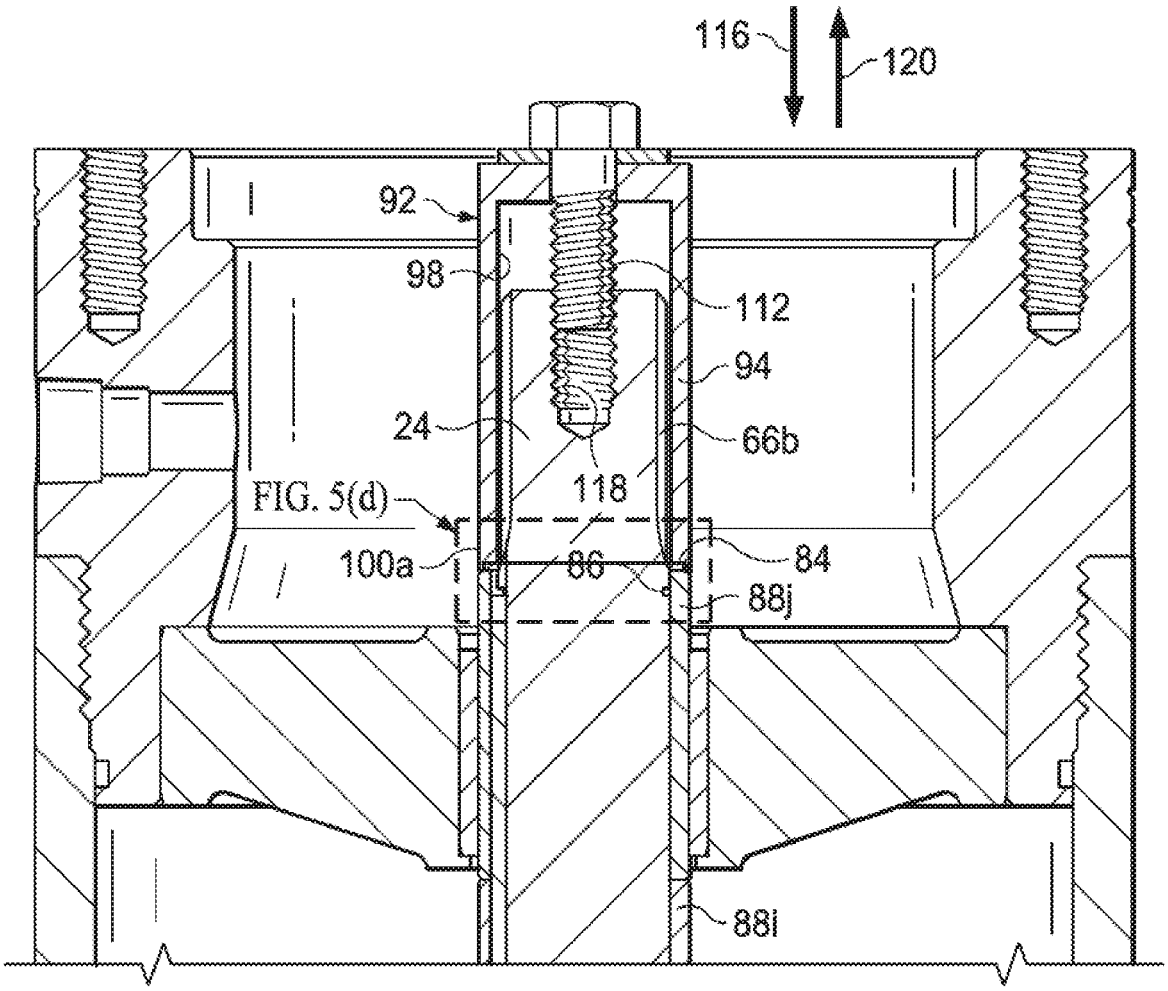
Figure 5D:
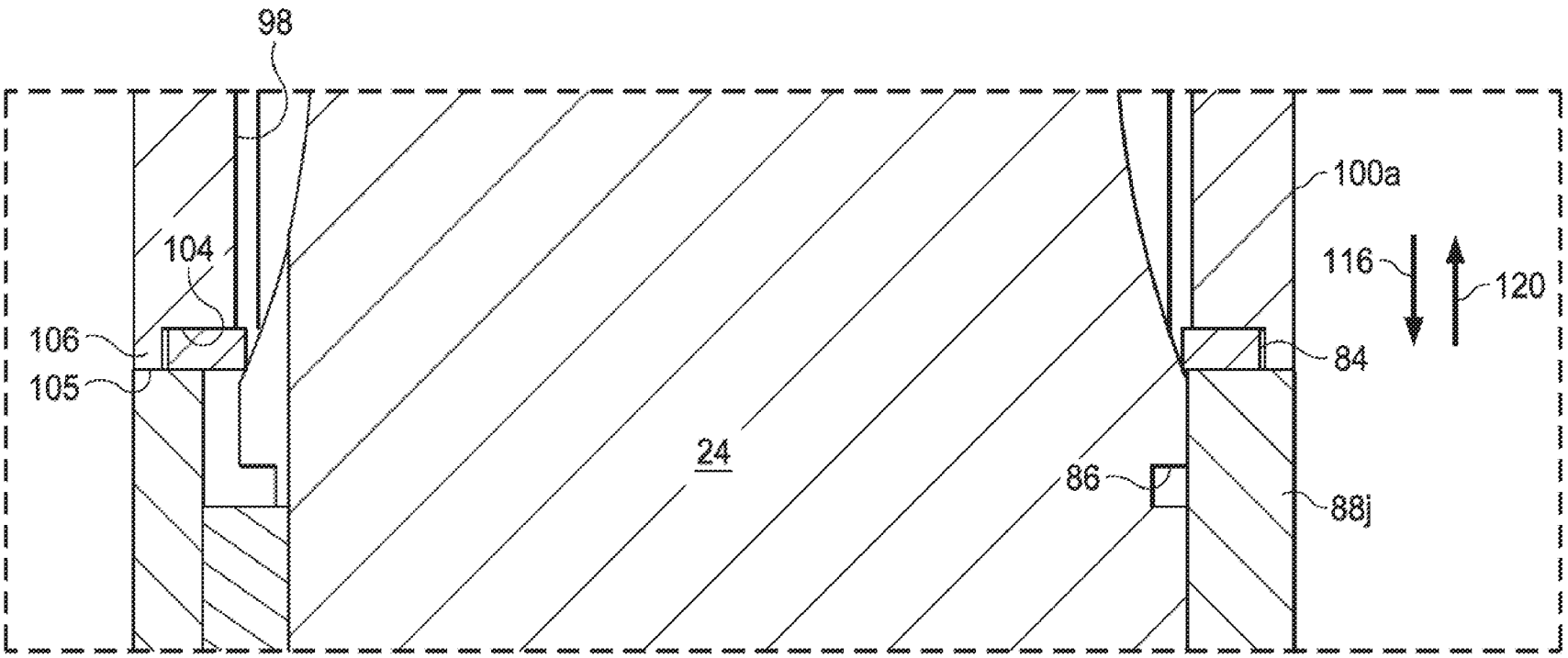
Figure 5E:
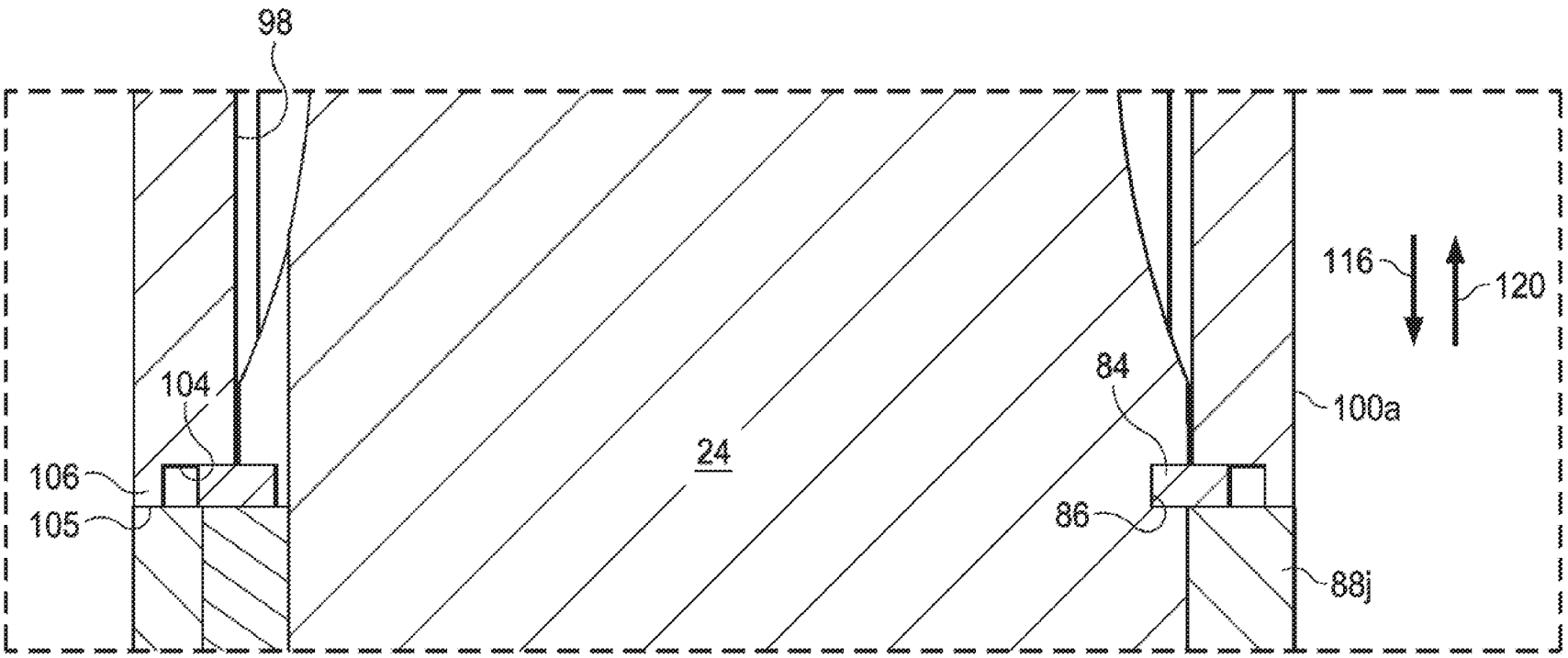

In an embodiment, as illustrated in FIG. 4, an impeller stack compression device is generally referred to by the reference numeral 92 and includes a compression cylinder 94 and a compression implement 96. The compression cylinder 94 defines an internal cavity 98 and opposing end portions 100*a* and 100*b*. In some embodiments, the end portion 100*a* of the compression cylinder 94 is open and is thus referred to as the "open end portion 100*a*" of the compression cylinder 94. In some embodiments the end portion 100*b* of the compression cylinder 94 is closed and is thus referred to as the "closed end portion 100*b*" of the compression cylinder 94. In some embodiments, the compression cylinder 94 includes both the open end portion 100*a* and the closed end portion 100*b*. In an embodiment, as shown in FIG. 4, a counterbore 102 is formed into the compression cylinder 94 at the open end portion 100*a*. The counterbore 102 defines an internal shoulder 104 in the compression cylinder 94 at the open end portion 100*a*. The internal annular shoulder is recessed from an external end face 105 of the compression cylinder 94 adjacent the counterbore 102. As a result, an external annular lip 106 extends axially between the internal shoulder 104 and the external end face 105 of the compression cylinder 94. In some embodiments, one or more gaps are formed radially through the external annular lip 106 to accommodate tabs of the annular retainer 84; the tabs may be used, for example, to manipulate the annular retainer 84 onto the end portion 66*b* of the pump shaft 24 prior to detachably connecting the annular retainer 84 to the pump shaft 24, as will be described in further detail below. Alternatively, the tabs may be omitted from the annular retainer 84 and the one or more gaps may be omitted from the compression cylinder 94.

In some embodiments, one of which is shown in FIG. 4, the compression implement 96 includes a washer 110 extending adjacent the closed end portion 100*b* of the compression cylinder 94 and a fastener 112 extending through the washer 110 and into the internal cavity 98 of the compression cylinder 94 via an opening 114 formed in the closed end portion 100*b*. The compression implement 96 is thus configured to engage the pump shaft 24 to axially compress the plurality of impellers, including the impellers 22*a* and 22*b*, and the plurality of annular spacers, including the annular spacers 88*a-j*, between the annular retainer 80 and the compression cylinder 94, and, once so axially compressed, to detachably connect the annular retainer 84 to the pump shaft 24, as will be described in further detail below. The plurality of annular spacers, including the annular spacers 88*a-j*, and the plurality of impellers, including the impellers 22*a* and 22*b*, may be together referred to as the "impeller stack," and the compression of the plurality of annular spacers, including the annular spacers 88*a-j*, and the plurality of impellers, including the impellers 22*a* and 22*b*, between the annular retainer 80 and the compression cylinder 94 may be referred to as "impeller stack compression." Moreover, although described herein as including the washer 110 and the fastener 112, the compression implement 96 may instead take the form of another implement capable of axially compressing the plurality of impellers, including the impellers 22*a* and 22*b*, and the plurality of annular spacers, including the annular spacers 88*a-j*, between the annular retainer 80 and the compression cylinder 94.

In an embodiment, as illustrated in FIGS. 5(*a*)-(*e*) with continuing reference to FIGS. 1(*a*)-(*b*), 2, 3, and 4, the impeller stack compression device 92 is operable to axially compress the plurality of impellers, including the impellers 22*a* and 22*b*, and the plurality of annular spacers, including the annular spacers 88*a-j*, between the annular retainer 80 and the compression cylinder 94, and, once so axially compressed, to detachably connect the annular retainer 84 to the pump shaft 24. The annular retainer 84 is placed in the counterbore 102 of the compression cylinder 94. In some embodiments, the annular retainer 84, the counterbore 102, the end face 105, and the external annular lip 106 are sized and shaped so that, when the annular retainer 84 is placed in the counterbore 102, the annular retainer 84 engages the internal shoulder 104 and is recessed from the end face 105, as shown in FIGS. 5(*a*)-(*e*). That is, the external annular lip 106 and thus the end face 105 protrudes axially past the annular retainer 84 when the annular retainer 84 is placed in the counterbore 102 against the internal shoulder 104.

Before, during, or after the placement of the annular retainer 84 in the counterbore 102 of the compression cylinder 94, the compression cylinder 94 is moved in a direction 116 so that the open end portion 100*a* of the compression cylinder 94 is placed around the end portion 66*b* of the pump shaft 24 and at least part of the pump shaft 24 extends within the internal cavity 98 of the compression cylinder 94. The compression cylinder continues to be so moved in the direction 116 until the fastener 112 contacts an opening 118 formed in the end portion 66*b* of the pump shaft 24, as shown in FIG. 5(*b*). In some embodiments, the fastener 112 is a threaded fastener and the opening 118 formed in the end portion 66*b* of the pump shaft 24 is a threaded opening.

Once the fastener 112 contacts the opening 118 formed in the end portion 66*b* of the pump shaft 24, the fastener 112 is engaged with the opening 118 (e.g., threadably) to further advance the compression cylinder 94 in the direction 116. The compression cylinder 94 continues to be so advanced in the direction 116 by the engagement of the fastener 112 with the opening 118 until the end face 105 of the compression cylinder 94 contacts the annular spacer 88*j* (or another one of the plurality of annular spacers), as shown in FIGS. 5(*c*) and 5(*d*). In some embodiments, the position at which the end face 105 of the compression cylinder 94 first contacts the annular spacer 88*j* (or the another one of the plurality of annular spacers) is offset from the annular groove 86 in a direction 120, which is opposite the direction 116.

After the end face 105 of the compression cylinder 94 first contacts the annular spacer 88*j* (or the another one of the plurality of annular spacers), the compression cylinder 94 continues to be advanced in the direction 116 by the engagement of the fastener 112 with the opening 118. This continued advancement of the compression cylinder 94 in the direction 116 after the end face 105 of the compression cylinder 94 first contacts the annular spacer 88*j* (or the another one of the plurality of annular spacers) compresses the plurality of annular spacers, including the spacers 88*a-j*, and the plurality of impellers, including the impellers 22*a* and 22*b*, between the annular retainer 80 and the end face 105 of the compression cylinder 94. The plurality of annular spacers, including the spacers 88*a-j*, and the plurality of impellers, including the impellers 22*a* and 22*b*, continue to be so compressed between the annular retainer 80 and the end face 105 of the compression cylinder 94 to an increasing degree until the position at which the end face 105 of the compression cylinder 94 contacts the annular spacer 88*j* (or the another one of the plurality of annular spacers) is no longer offset from the annular groove 86 in the direction 120. That is, the compression cylinder 94 continues to be advanced in the direction 116 until the annular retainer 84 is aligned with the annular groove 86, at which point the annular retainer 84 "springs" into the annular groove 86 to thereby detachably connect the annular retainer 84 to the pump shaft 24, as shown in FIG. 5(*e*).

In some embodiments, the contact between the end face 105 of the compression cylinder 94 and the annular spacer 88*j* (or the another one of the plurality of annular spacers) prevents, or at least reduces, compression of the annular retainer 84 between the of the internal shoulder 104 and the annular spacer 88*j* (or the another one of the plurality of annular spacers), thereby permitting the annular retainer 84 to spring into the annular groove 86. In some embodiments, without such contact between the end face 105 of the compression cylinder 94 and the annular spacer 88*j* (or the another one of the plurality of annular spacers), the annular retainer 84 would be prevented from springing into the annular groove 86 by the compression of the annular retainer 84 between the of the internal shoulder 104 and the annular spacer 88*j* (or the another one of the plurality of annular spacers). In some embodiments, once the annular retainer 84 is detachably connected to the pump shaft 24 (i.e., by springing into the annular groove 86), an outside diameter D1 of the annular retainer 84 is less than, or equal to, an outside diameter D2 of one or more of the plurality of annular spacers, including the annular spacers 88*a-j*, as shown in Figure. In some embodiments, once the annular retainer 84 is detachably connected to the pump shaft 24 (i.e., by springing into the annular groove 86), the outside diameter D1 of the annular retainer 84 is less than, or equal to, the outside diameter D2 of the annular spacer 88*j*.

Once the annular retainer 84 is detachably connected to the pump shaft 24 by springing into the annular groove 86, the compression cylinder 94 is removable from the end portion 66*b* of the pump shaft 24 so that the plurality of annular spacers, including the annular spacers 88*a-j*, and the plurality of impellers, including the impellers 22*a* and 22*b*, are compressed between the annular retainer 80 and the annular retainer 84. In some embodiments, this compression of the plurality of annular spacers, including the annular spacers 88*a-j*, and the plurality of impellers, including the impellers 22*a* and 22*b*, between the annular retainer 80 and the annular retainer 84 maintains proper spacing between the annular retainer 80, the impeller 22*a*, the impeller 22*b*, and the annular retainer 84 so that the impellers 22*a* and 22*b* are properly positioned within the diffusers 20*a* and 20*b*, respectively, to facilitate efficient operation of the centrifugal pump 10. In some embodiments, the annular retainer 84 includes multiple annular retainers detachably connected to the pump shaft 24 (e.g., via installation into the annular groove 86) to ensure the integrity and effectiveness of the annular retainer 84 in maintaining the compression of the annular spacers, including the annular spacers 88*a-j*, and the plurality of impellers, including the impellers 22*a* and 22*b*, between the annular retainer 80 and the annular retainer 84.

In some embodiments, the impeller stack compression device 92 addresses one or more issues associated with existing compression devices. In some embodiments, the impeller stack compression device 92 does not remain on the pump shaft 24 during operation of the centrifugal pump 10. In some embodiments, because the impeller stack compression device 92 does not remain on the pump shaft 24 during operation of the centrifugal pump 10, the impeller stack compression device 92 does not impede or obstruct fluid flow through the centrifugal pump 10, and so does not cause undesirable turbulence in the fluid flow and/or vibration of the centrifugal pump 10. In some embodiments, the impeller stack compression device 92 installs an inexpensive and low profile mechanical fastener (i.e., the annular retainer 84) onto the pump shaft 24 after the desired impeller stack compression has been achieved. In some embodiments, the annular retainer 84 installed by the impeller stack compression device 92 is less bulky and expensive than existing compression devices. In some embodiments, to the extent the annular retainer 84 installed by the impeller stack compression device 92 impedes or obstructs fluid flow through the centrifugal pump 10, such impedance or obstruction is negligible as compared to the impedance or obstruction of fluid flow through the centrifugal pump 10 that would be created by an existing compression device. In some embodiments, the impedance or obstruction of the fluid flow in the centrifugal pump 10 caused by the annular retainer 84 is negligible because the outside diameter D1 of the annular retainer 84 is less than, or equal to, the outside diameter D2 of one or more of the plurality of annular spacers, including the annular spacers 88*a-j*. In some embodiments, the impedance or obstruction of the fluid flow in the centrifugal pump 10 caused by the annular retainer 84 is negligible because the outside diameter D1 of the annular retainer 84 is less than, or equal to, the outside diameter D2 of the annular spacers 88*j*. In some embodiments, the annular retainer 84 installed by the impeller stack compression device 92 does not cause undesirable turbulence in the fluid flow and/or vibration of the centrifugal pump 10.

The present disclosure introduces an apparatus for a centrifugal pump, the apparatus including an annular retainer positionable around a first end portion of a pump shaft; and a compression cylinder including an internal cavity and an open end portion positionable around the first end portion of the pump shaft so that the pump shaft extends within the internal cavity; wherein, when the annular retainer is positioned around the first end portion of the pump shaft and the open end portion of the compression cylinder is positioned around the first end portion of the pump shaft so that the pump shaft extends within the internal cavity, the compression cylinder is movable towards an annular groove formed in the first end portion of the pump shaft to thereby spring the annular retainer into the annular groove. In some embodiments, when the compression cylinder moves towards the annular groove formed in the first end portion of the pump shaft to thereby spring the annular retainer into the annular groove, the open end portion of the compression cylinder is engageable with: one or more annular spacers extending around the shaft; or one or more impellers extending around the shaft. In some embodiments, the apparatus further includes the pump shaft, the one or more impellers, and the one or more annular spacers. In some embodiments, the open end portion of the compression cylinder includes a counterbore in which the annular retainer is configured to extend when the open end portion of the compression cylinder engages the one or more annular spacers extending around the shaft or the one or more impellers extending around the shaft; and the extension of the annular retainer within the counterbore prevents, or at least reduces, compression of the annular retainer between the open end portion of the compression cylinder and the one or more annular spacers extending around the shaft or the one or more impellers extending around the shaft, thereby allowing the annular retainer to spring into the annular groove. In some embodiments, when the annular retainer springs into the annular groove, the one or more impellers and the one or more annular spacers are constrained between the annular retainer and another annular retainer connected to the pump shaft. In some embodiments, the apparatus further includes a compression implement configured to move the compression cylinder towards the annular groove formed in the first end portion of the pump shaft. In some embodiments, the compression implement includes a threaded fastener configured to engage a threaded opening formed in the first end portion of the pump shaft.

The present disclosure also introduces a method for a centrifugal pump, the method including positioning an annular retainer around a first end portion of a pump shaft; positioning an open end portion of a compression cylinder around the first end portion of the pump shaft so that the pump shaft extends within an internal cavity of the compression cylinder; moving the compression cylinder towards an annular groove formed in the first end portion of the pump shaft; and springing the annular retainer into the annular groove. In some embodiments, moving the compression cylinder towards the annular groove formed in the first end portion of the pump shaft includes engaging the open end portion of the compression cylinder with: one or more annular spacers extending around the shaft; or one or more impellers extending around the shaft. In some embodiments, the open end portion of the compression cylinder includes a counterbore in which the annular retainer is configured to extend when the open end portion of the compression cylinder engages the one or more annular spacers extending around the shaft or the one or more impellers extending around the shaft. In some embodiments, the extension of the annular retainer within the counterbore prevents, or at least reduces, compression of the annular retainer between the open end portion of the compression cylinder and the one or more annular spacers extending around the shaft or the one or more impellers extending around the shaft, thereby allowing the annular retainer to spring into the annular groove. In some embodiments, springing the annular retainer into the annular groove constrains the one or more impellers and the one or more annular spacers between the annular retainer and another annular retainer connected to the pump shaft. In some embodiments, moving the compression cylinder towards the annular groove formed in the first end portion of the pump shaft includes engaging a compression implement with the pump shaft. In some embodiments, the compression implement includes a threaded fastener and engaging the compression implement with the pump shaft includes engaging the threaded fastener with a threaded opening formed in the first end portion of the pump shaft.

The present disclosure also introduces an apparatus for a centrifugal pump, the apparatus including a pump shaft defining opposing first and second end portions and having an annular groove formed in the first end portion; a first annular retainer connected to the pump shaft at the second end portion; one or more impellers extending around the shaft between the first annular retainer and the annular groove; one or more annular spacers extending around the shaft between the first annular retainer and the annular groove; and a second annular retainer extending within the annular groove; wherein the one or more impellers and the one or more annular spacers are constrained between the first annular retainer and the second annular retainer. In some embodiments, the one or more impellers include first and second impellers; and the constraint of the first and second impellers and the one or more annular spacers between the first annular retainer and the second annular retainer maintains a spacing between the first and second impellers. In some embodiments, the second annular retainer extending within the annular groove defines a first outside diameter that is less than, or equal to, a second outside diameter of the one or more annular spacers. In some embodiments, the one or more impellers and the one or more annular spacers are compressed between the first annular retainer and the second annular retainer. In some embodiments, the second annular retainer includes a spiral retainer ring. In some embodiments, the second annular retainer includes multiple annular retainers extending within the annular groove.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. An apparatus for a centrifugal pump, the apparatus comprising:

an annular retainer positionable around a first end portion of a pump shaft; and a compression cylinder comprising an internal cavity and an open end portion positionable around the first end portion of the pump shaft so that the pump shaft extends within the internal cavity;

wherein, when the annular retainer is positioned around the first end portion of the pump shaft and the open end portion of the compression cylinder is positioned around the first end portion of the pump shaft so that the pump shaft extends within the internal cavity, the compression cylinder is movable towards an annular groove formed in the first end portion of the pump shaft to thereby spring the annular retainer into the annular groove.

2. The apparatus of claim 1, wherein, when the compression cylinder moves towards the annular groove formed in the first end portion of the pump shaft to thereby spring the annular retainer into the annular groove, the open end portion of the compression cylinder is engageable with:

one or more annular spacers extending around the pump shaft; or one or more impellers extending around the pump shaft.

3. The apparatus of claim 2, further comprising the pump shaft, the one or more impellers, and the one or more annular spacers.

4. The apparatus of claim 2, wherein the open end portion of the compression cylinder includes a counterbore in which the annular retainer is configured to extend when the open end portion of the compression cylinder engages the one or more annular spacers extending around the shaft or the one or more impellers extending around the shaft; and wherein the extension of the annular retainer within the counterbore prevents, or at least reduces, compression of the annular retainer between the open end portion of the compression cylinder and the one or more annular spacers extending around the shaft or the one or more impellers extending around the shaft, thereby allowing the annular retainer to spring into the annular groove.

5. The apparatus of claim 2, wherein, when the annular retainer springs into the annular groove, the one or more impellers and the one or more annular spacers are constrained between the annular retainer and another annular retainer connected to the pump shaft.

6. The apparatus of claim 1, further comprising a compression implement configured to move the compression cylinder towards the annular groove formed in the first end portion of the pump shaft.

7. The apparatus of claim 6, wherein the compression implement comprises a threaded fastener configured to engage a threaded opening formed in the first end portion of the pump shaft.

8. A method for a centrifugal pump, the method comprising:

positioning an annular retainer around a first end portion of a pump shaft;

positioning an open end portion of a compression cylinder around the first end portion of the pump shaft so that the pump shaft extends within an internal cavity of the compression cylinder;

moving the compression cylinder towards an annular groove formed in the first end portion of the pump shaft; and springing the annular retainer into the annular groove.

9. The method of claim 8, wherein moving the compression cylinder towards the annular groove formed in the first end portion of the pump shaft comprises engaging the open end portion of the compression cylinder with:

one or more annular spacers extending around the shaft; or one or more impellers extending around the shaft.

10. The method of claim 9, wherein the open end portion of the compression cylinder includes a counterbore in which the annular retainer is configured to extend when the open end portion of the compression cylinder engages the one or more annular spacers extending around the shaft or the one or more impellers extending around the shaft.

11. The method of claim 10, wherein the extension of the annular retainer within the counterbore prevents, or at least reduces, compression of the annular retainer between the open end portion of the compression cylinder and the one or more annular spacers extending around the shaft or the one or more impellers extending around the shaft, thereby allowing the annular retainer to spring into the annular groove.

12. The method of claim 9, wherein springing the annular retainer into the annular groove constrains the one or more impellers and the one or more annular spacers between the annular retainer and another annular retainer connected to the pump shaft.

13. The method of claim 8, wherein moving the compression cylinder towards the annular groove formed in the first end portion of the pump shaft comprises engaging a compression implement with the pump shaft.

14. The method of claim 13, wherein the compression implement comprises a threaded fastener and engaging the compression implement with the pump shaft comprises engaging the threaded fastener with a threaded opening formed in the first end portion of the pump shaft.

15. An apparatus for a centrifugal pump, the apparatus comprising:

a pump shaft defining opposing first and second end portions and having an annular groove formed in the first end portion;

a first annular retainer connected to the pump shaft at the second end portion;

one or more impellers extending around the pump shaft between the first annular retainer and the annular groove;

one or more annular spacers extending around the pump shaft between the first annular retainer and the annular groove; and a second annular retainer extending within the annular groove;

wherein the one or more impellers and the one or more annular spacers are constrained between the first annular retainer and the second annular retainer, wherein the second annular retainer extending within the annular groove defines a first outside diameter that is less than, or equal to, a second outside diameter of the one or more annular spacers.

16. The apparatus of claim 15, wherein the one or more impellers comprise first and second impellers; and wherein the constraint of the first and second impellers and the one or more annular spacers between the first annular retainer and the second annular retainer maintains a spacing between the first and second impellers.

17. The apparatus of claim 15, wherein the one or more impellers and the one or more annular spacers are compressed between the first annular retainer and the second annular retainer.

18. The apparatus of claim 15, wherein the second annular retainer comprises a spiral retainer ring.

19. The apparatus of claim 15, wherein the second annular retainer comprises multiple annular retainers extending within the annular groove.

* * * * *